US007159940B1

(12) United States Patent
Atkins

(10) Patent No.: US 7,159,940 B1
(45) Date of Patent: Jan. 9, 2007

(54) ECCENTRICALLY ROTATABLE SWIVEL SEAT DEVICE

(76) Inventor: Jerry Mac Atkins, 252 Crystal Springs Dr., Lexington, SC (US) 29073

( * ) Notice: Subject to any disclaimer, the term of this patent is extended or adjusted under 35 U.S.C. 154(b) by 0 days.

(21) Appl. No.: 10/906,451

(22) Filed: Jul. 25, 2005

(51) Int. Cl.
*A47C 1/08* (2006.01)

(52) U.S. Cl. ..... 297/242; 297/240; 297/344.26

(58) Field of Classification Search ..... 297/240, 297/242, 250.1, 256.12, 256.16, 352, 344.26; 248/349.1, 425
See application file for complete search history.

(56) References Cited

U.S. PATENT DOCUMENTS

| | | | | |
|---|---|---|---|---|
| 2,841,207 | A * | 7/1958 | Sweeney | 297/252 |
| 3,043,622 | A * | 7/1962 | Milner | 297/240 |
| 4,034,947 | A | 7/1977 | Geisel | |
| 4,659,050 | A | 4/1987 | Tabayashi | |
| 5,318,339 | A * | 6/1994 | Cherniak | 297/344.26 |
| 5,427,426 | A | 6/1995 | Grappo | |
| 5,441,329 | A | 8/1995 | Janisch | |
| 5,474,353 | A | 12/1995 | Koester et al. | |
| 5,779,309 | A | 7/1998 | Lu | |
| 6,015,188 | A * | 1/2000 | Yundt et al. | 297/344.21 |
| 6,237,999 | B1 * | 5/2001 | Hobson | 297/256.15 |
| 6,241,314 | B1 * | 6/2001 | Pufall | 297/256.12 |
| 6,447,065 | B1 | 9/2002 | Ropp | |
| 6,863,345 | B1 * | 3/2005 | Kain | 297/256.16 |
| 6,938,954 | B1 * | 9/2005 | Hendren et al. | 297/256.12 |

* cited by examiner

*Primary Examiner*—Peter R. Brown
(74) *Attorney, Agent, or Firm*—Theresa M. Seal

(57) ABSTRACT

A swivel seat device is disclosed for bringing an individual adjacent to a table without moving or lifting the chair the individual is seated upon includes an upper supporting member eccentrically pivotally interconnected to a lower supporting member whereupon the individual sits on the upper supporting member that is eccentrically rotated so that the individual is brought adjacent and forward to the table without ever moving the chair. The lower supporting member is secured to the seat rest of the chair by flexible straps that wrap around both the chair seat rest and the lower supporting member for attachment beneath the chair seat rest. The upper supporting member can also include a semi-circular backrest upwardly extending from the periphery of the upper supporting member to provide further support for the individual seated thereon.

18 Claims, 8 Drawing Sheets

ECCENTRICALLY ROTATABLE SWIVEL SEAT DEVICE

The field of the invention pertains to seat accessories and assists, and more particularly pertains to a seat accessory with an off-center rotation for moving a seated individual, especially an elderly, disabled, or handicapped individual, closer to a table or desk while remaining on the chair and without having to physically move the chair closer to the table or desk.

BACKGROUND OF THE INVENTION

Assists and devices to aid elderly, infirm, handicapped or disabled individuals range from simple walkers and hearing aids to artificial implants that replace weakened, decayed or malfunctioning bones, joints and organs. The elderly and the handicapped face physical constraints, inconveniences and difficulties when accomplishing or performing even the simplest, perfunctory tasks—such as seating themselves at the dining table or at a desk. For example, the standard way for an elderly or handicapped individual to seat himself or herself adjacent and forward to, for example, a dining table, is to first position the chair a sufficient distance from the table so that the individual can first be positioned between the chair and table. The difficulties now arise as the individual must drag or slide the chair to the table with the individual half-standing so that his or her full weight is not upon the chair. This is generally a difficult, if not impossible task, as elderly or handicapped individuals simply lack the arm and upper body strength to drag a chair (whether it is a folding chair or a heavy wooden chair) across a floor. Given this insuperable impediment to seating at a table, one option is to position the chair at an angle to the table so that the individual can partially squeeze onto the chair so as to avoid the difficulty of having to drag the chair forward and adjacent to the table.

However, this maneuver can lead to unpleasant and dangerous falls, as elderly and handicapped individuals are generally physically unsteady. This problem of properly seating an elderly, disabled or handicapped individual at a table is not obviated when other people—family members, spouse, health aides, for example—are available to provide assistance. For instance, even if the chair has been moved far enough away from the table so that the elderly individual can sit in the chair, the family member will still need to turn, move or push the chair, with the individual seated thereon, forward to the table. This is not an easy task even if the elderly individual is considered, in general terms, small and lightweight. Thus, various types of devices have been conceived to assist in the positioning of an individual adjacent and forward to a table or desk. Such devices have also been broadened to assist an individual in entering and exiting from the seat of an automotive vehicle.

For example, the Geisel patent (U.S. Pat. No. 4,034,947) discloses a rotating seat device that includes a pair of rotatably interconnected circular pad members with the upper pad member rotatable relative to the lower pad member, and the lower pad member frictionally engaging the seat cover of the seat for maintaining its stationary position thereon.

The Tabayashi patent (U.S. Pat. No. 4,659,050) discloses a rotary support device that includes upper and lower rings rotatable relative to each other by enclosing therebetween ball bearings held in place by a separator.

The Grappo patent (U.S. Pat. No. 5,427,426) discloses a seat accessory that includes a seat element having an ergonomic saddle-shaped configuration and that rotates on a base element that is attached to a vehicle seat for allowing the ingress and egress of an individual to and from a vehicle.

The Janisch patent (U.S. Pat. No. 5,441,329) discloses a rotatable seat that includes a top plate pivotally secured to a bottom plate, and the top plate including a polygonal periphery for engaging and holding thereon an upholstery pad.

The Koester et al. patent (U.S. Pat. No. 5,474,353) discloses a pivoting seat portion for vehicles that includes a fixed seat portion on which a pivotal seat portion is mounted so that the pivot seat portion can pivot slightly past the vehicle sill or rocker edge of the vehicle seat thereby facilitating vehicle ingress and egress.

The Lu patent (U.S. Pat. No. 5,779,309) discloses a swivel plate device that includes a rotating plate pivotally interconnected to a base plate through a main post with a cover placed upon the rotating plate and a return spring interconnecting the rotating plate with the base plate.

The Ropp patent (U.S. Pat. No. 6,447,065 B1) discloses an adjustable swivel assembly that includes a first swivel plate, a second swivel plate, and a plurality of ball bearings enclosed therebetweeen and in contact with an adjustment plate so that the pressure on the bearings can be increased or decreased for adjusting the suspension of the seat. Nonetheless, despite the ingenuity of the above devices, there remains a need for a swivel seat device that facilitates the positioning of an individual, especially a handicapped or elderly individual, adjacent to a table or desk while avoiding the problem of having to push, lift or move the entire chair, with the individual seated thereon, to the table so that the individual can be properly seated.

SUMMARY OF THE INVENTION

The present invention comprehends an eccentrically rotatable swivel seat device that is securable to a chair, such as a standard dining chair, for positioning an individual seated on a rotatable member of the device forward and adjacent to the table. The device is especially useful for seating elderly, infirm, or handicapped individuals at the table while avoiding the difficulties involved in moving the entire chair to the table.

The present invention includes a circular lower supporting member that is fixedly secured to the seat rest of the chair by flexible straps that encompass both the chair seat rest and the lower supporting member. A circular upper supporting member is interconnected to the lower supporting member for rotatable or swiveling motion thereon relative to the stationarily secured lower supporting member. Moreover, the upper supporting member is eccentrically or off-centeredly interconnected to the lower supporting member so that the upper supporting member swivels the individual forward and adjacent to the table. In place of the flexible straps, the lower supporting member can be secured to the seat rest of the chair by retaining members that clip to the chair seat rest. In addition, the upper supporting member can be modified to include a semi-circular backrest that upwardly extends from the periphery of the upper supporting member for use with, for example, a bar stool.

It is an objective of the present invention to provide an eccentrically rotatable swivel seat device that seats the individual closer to the table and obviates the need to push, lift or move the chair, with the individual seated thereon, closer to the table.

It is another objective of the present invention to provide an eccentrically rotatable swivel seat device that is a convenient assistance device for elderly, disabled or handicapped individuals.

It is yet another objective of the present invention to provide an eccentrically rotatable swivel seat device that will assist any individual that has difficulty or is unable to physically move the chair forward in order to sit comfortably at the table and backward in order to exit the table.

It is still yet another objective of the present invention to provide an eccentrically rotatable swivel seat device that can be easily and quickly attached to and detached from the chair or stool, as the situation requires.

Still yet another objective of the present invention is to provide an eccentrically rotatable swivel seat device that gives the elderly, handicapped or disabled individual a measure of independence by allowing such individuals to perform the task of seating themselves forward and close to the dining table or desk by their own efforts.

Still yet a further objective of the present invention is to provide an eccentrically rotatable swivel seat device that can be utilized in small apartments and mobile homes, and in other cramped quarters, for seating the individual adjacent to the dining table.

These and other objects, features and advantages will become apparent to one skilled in the art upon a perusal of the following detailed description read in conjunction with the accompanying drawing figures.

DETAILED DESCRIPTION OF THE PREFERRED EMBODIMENT

Figure 1:
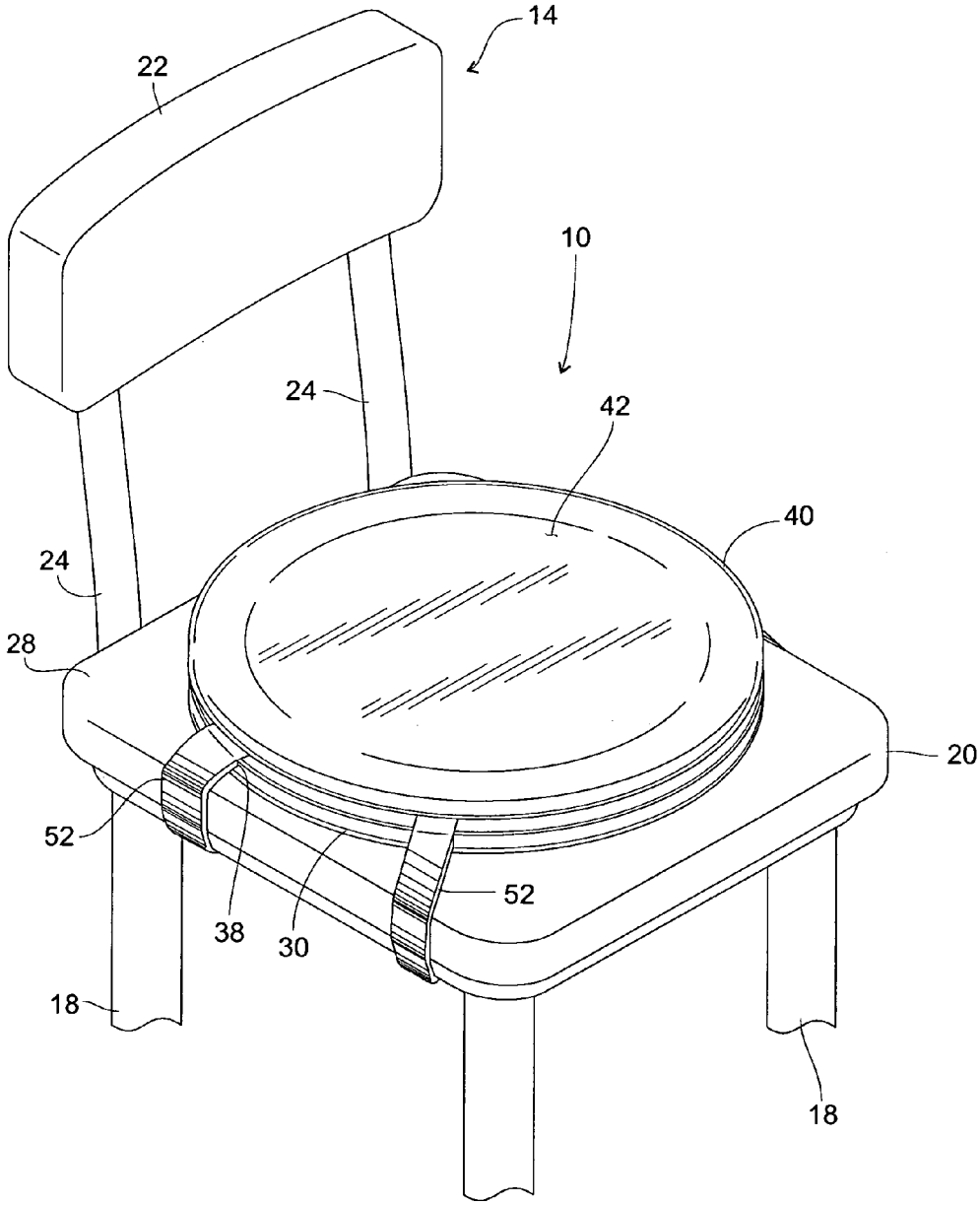
FIG. 1 is a perspective view of the eccentrically rotatable swivel seat device of the present invention illustrating the attachment of the swivel seat device to the seat rest of a chair.
Figure 2:
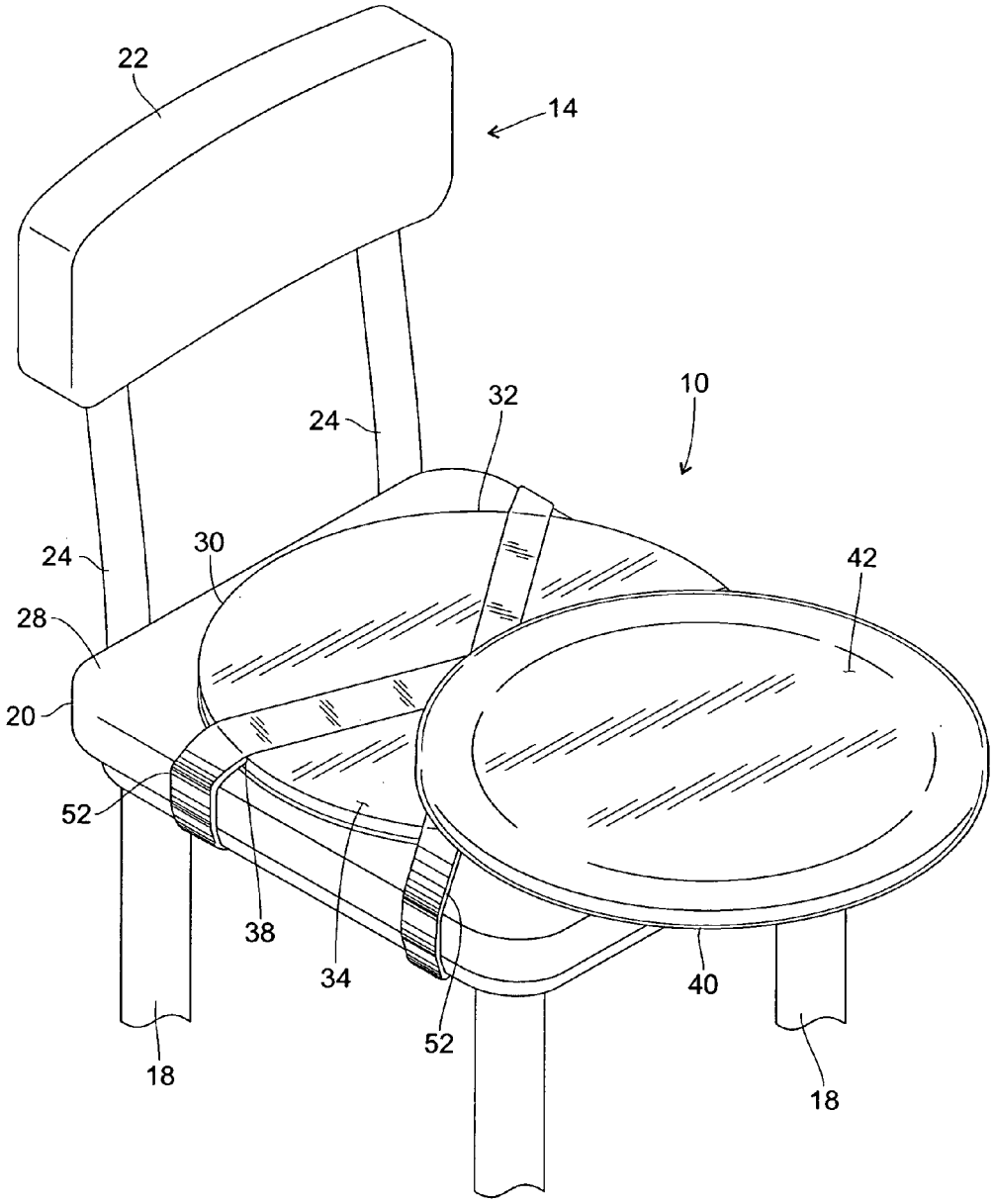
FIG. 2 is a perspective view of the eccentrically rotatable swivel seat device of the present invention illustrating the disposition of the upper supporting member when rotated to bring the individual closer to the table.
Figure 3:
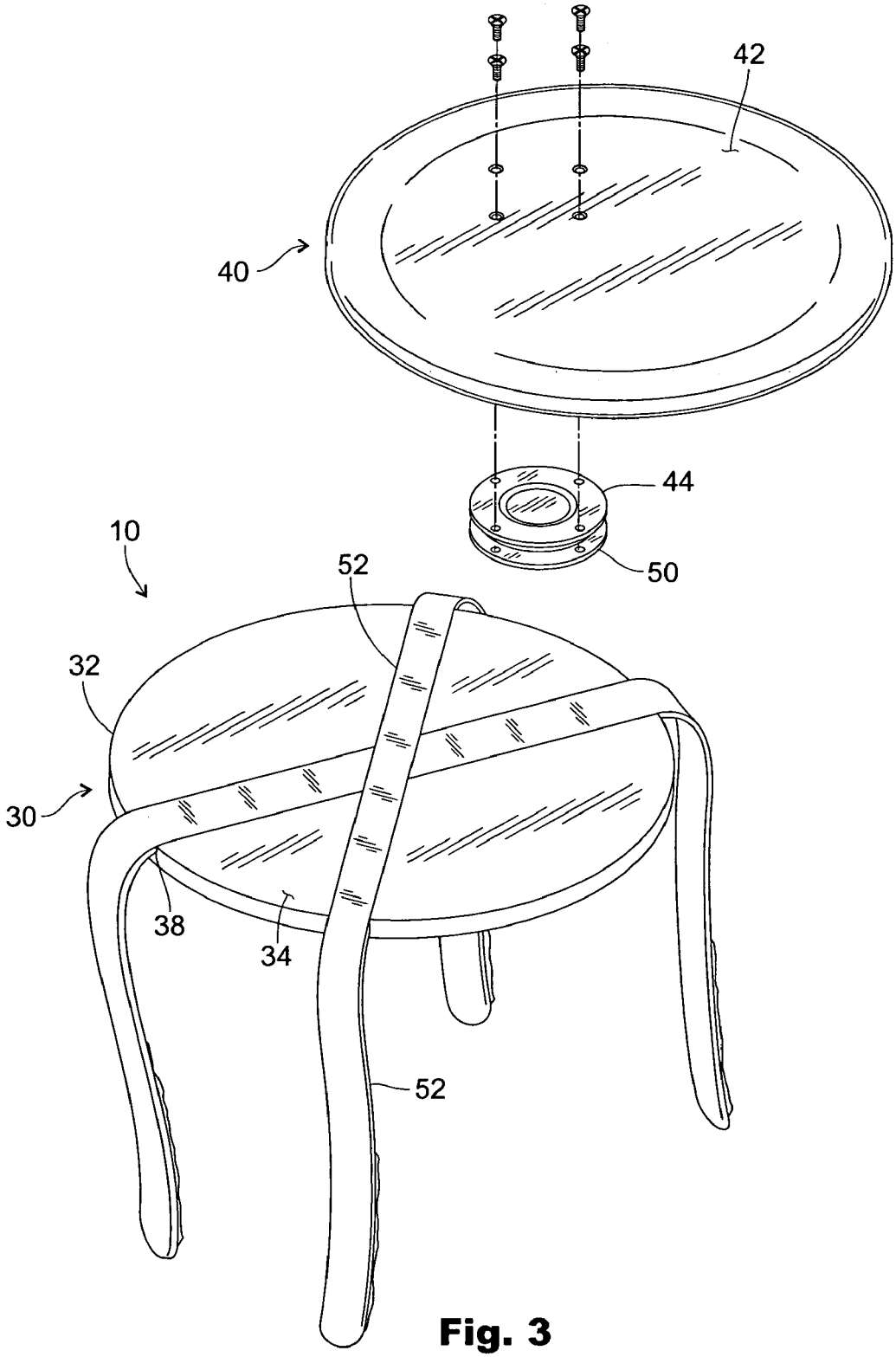
FIG. 3 is a perspective view of the eccentrically rotatable swivel seat device of the present invention illustrating the swiveling interconnection of the upper supporting member to the lower supporting member.
Figure 4:
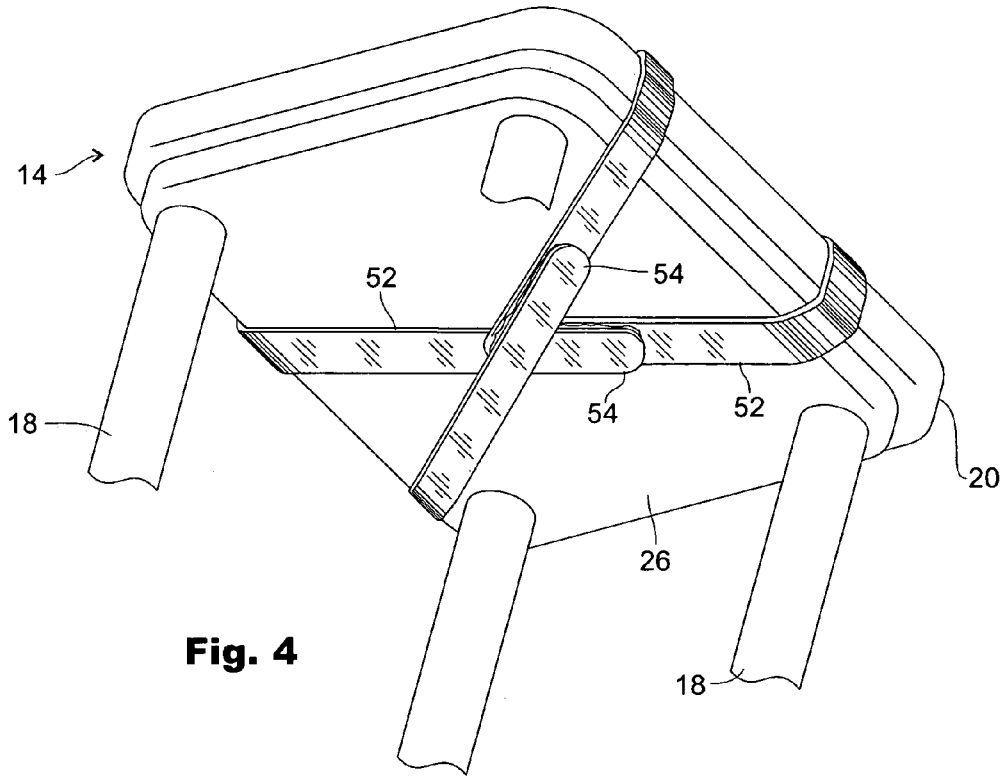
FIG. 4 is a perspective view of the eccentrically rotatable swivel seat device of the present invention illustrating the attachment of the swivel seat device at the underside of the seat rest of the chair.
Figure 5:
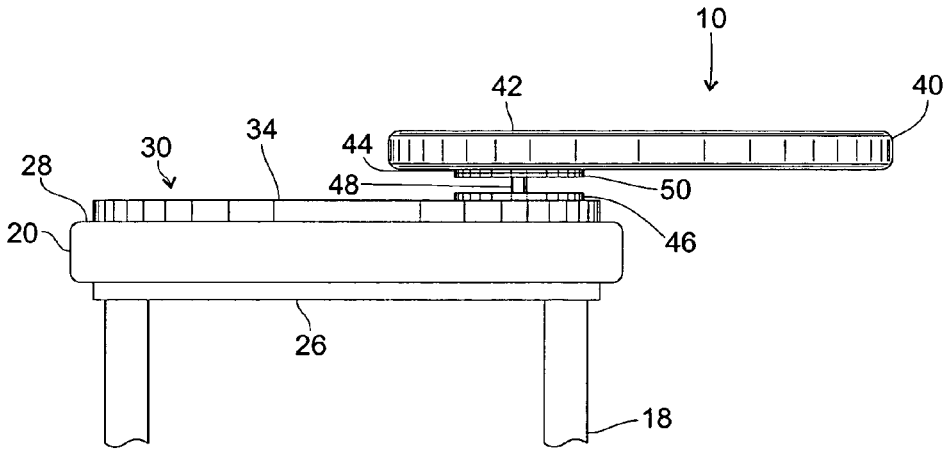
FIG. 5 is a side elevational view of the eccentrically rotatable swivel seat device of the present invention illustrating the disposition of the upper supporting member relative to the lower supporting member when the device is in the rotated position.

Illustrated in FIGS. 1–15 is a swivel seat device 10 for bringing individuals seated thereon closer to a dining table or desk. The individual is seated on the swivel seat device 10 and then swiveled or rotated so that he or she is seated forward and adjacent to the table. The swivel seat device 10 is especially useful, and provides the necessary assistance, for seating elderly, handicapped or disabled individuals that lack the ability and strength to lift or drag the chair to a position forward and adjacent to the table; the swivel seat device 10 essentially does the moving and positioning for the individual after the individual is seated on the device 10. In addition, the swivel seat device 10 of the present invention makes it much easier and convenient for spouses, family members, nurse's aides, etc., to move and position the elderly individual forward and adjacent to the table. All the family member needs to do is position the chair with the swivel seat device 10 attached thereto the appropriate distance from the table, assist the elderly individual in sitting upon the device 10, and then swivel or rotate the device 10 so that the elderly individual is seated forward at the table; the movement is accomplished by the device 10; and the family member does not need to lift, drag, or move the entire chair forward—with the elderly individual seated thereon—for placing the elderly individual at the table.

Thus, illustrated in FIGS. 1–7 is an individual 12 seated on a standard chair 14 before a table 16; the chair 14 can be a standard dining chair that includes legs 18, a seat rest 20, a back rest 22, and back rest stanchions 24 that extend upwardly from the seat rest 20 and on which the back rest 22 is secured. The seat rest 20 includes an underside 26 and an opposite upper side 28 on which an element of the swivel seat device 10 is superposed and then secured to as will be hereinafter described.

The swivel seat device 10 is a lightweight, durable assistance device that can be constructed from wood or molded plastic and decorated accordingly, and is easily and quickly removably attachable from one chair to another chair. The swivel seat device 10 includes, as shown in FIGS. 1–7, a circular-shaped lower supporting member 30 that includes a periphery 32 and preferably has a diameter of 18 inches. The lower supporting member 30 includes an interior surface 34 and an opposite seat rest engaging surface 36 that contacts the seat rest 20, and is the non-rotatable element of the swivel seat device 10 in so far as the lower supporting member 30 is secured to the seat rest 20 of the chair 14 in a fixed and stationary disposition. In addition, as shown in FIGS. 1–3, 5 and 11, a pair of channels or grooves 38 are integrally formed or molded on the interior surface 34 and extend transversely across the diameter of the lower supporting member 30 with the channels 38 crossing adjacent the center of the lower supporting member 10.

As shown in FIGS. 1–9 and 11–15, the swivel seat device 10 also includes an upper supporting member 40 on which the individual 12 sits for movement and positioning adjacent and forward to the table 16. The upper supporting member 40 is also circular-shaped and has the same preferable diameter—18 inches—as the lower supporting member 30. The upper supporting member 40 includes a seating surface 42 for supporting the individual 12 thereon. The upper supporting member 40 swivels or rotates relative to the stationarily mounted lower supporting member 30, and to provide for the seating of the individual 12 forward and adjacent to the table 16, and without moving the chair 14, the upper supporting member 40 is off-centered or eccentrically rotationally or pivotally interconnected to the lower supporting member 30. The eccentric pivotal mounting of the upper supporting member 40 allows the upper supporting member 40 to overhang or project beyond the periphery of the lower supporting member 30 so that the upper supporting member 40 is pendent relative to the lower supporting member 30 when fully rotated or swiveled. The eccentric rotational mounting of the upper supporting member 40 thus brings the individual 12 seated on the seating surface 42 of the upper supporting member 40 at least four inches closer to the table 16 when the upper supporting member 40 is fully rotated, and thus obviates the need to move or drag the entire chair 14 forward to the table 16.

As shown most specifically in FIGS. 3, 5, 12 and 13, a swiveling or pivotal means is used to pivotally interconnect the upper supporting member 40 to the lower supporting member 30. The swiveling means can include any standard type of bearing arrangement or a "Lazy Susan" arrangement; a representative swiveling means is shown in FIGS. 3, 5, 12 and 13, and includes a first plate 44 mounted to the underside of the upper supporting member 40. Secured to the interior surface 34 of the lower supporting member 30 is a bearing plate or bearing surface 46 with a post 48 extending upwardly therefrom. Pivotally mounted to the post 48 is a second plate 50 that is aligned with the first plate 44. The second plate 50 is secured to the first plate 44 by any conventional means such as fasteners thereby allowing the upper supporting member 40 to rotate or swivel on the post 48 and relative to the lower supporting member 30 while the lower supporting member 30 remains fixed and stationary on the seat rest 20 of the chair 14. Both the upper supporting member 40 and the lower supporting member 30 can include threaded apertures integrally molded into, respectively, the upper and lower supporting members 40 and 30 for mounting the plates 44 and 50 to the members 30 and 40. The swiveling interconnection means is shown for illustrative purposes and can be any suitable pivotal or swiveling arrangement known in the art.

FIGS. 1–4 illustrate a first preferred embodiment for a chair securement means for the swivel seat device 10. The securement means of FIGS. 1–4 includes a pair of elongated flexible straps 52 having lengths sufficient to completely wrap around and encompass both the lower supporting member 30 and the seat rest 20 of the chair 14. As specifically shown in FIGS. 3 and 4 the ends 54 of each strap 52 include the hook and loop fastening arrangement commonly known as Velcro R. In order to secure the lower supporting member 30 to the seat rest 20, and thus mount the swivel seat device 10 to the chair 14, the lower supporting member 30 is first positioned on the seat rest 20 with a portion of each strap 52 disposed in each channel 38 and the ends 54 of the straps 52 dangling freely down adjacent the legs 18 of the chair 14. Placement of portions of each strap 52 within the channels 38 maintains the position of the straps 52 on the lower supporting members 30 and prevents the straps 52 from moving or shifting. The ends 54 of each strap 52 are then completely wrapped around and beneath the seat rest 20 and brought together for securement adjacent the underside 26 of the seat rest 20. The hook and loop fastening arrangement extends along the ends 54 of each strap 52 to allow for the adjustable securement of the straps 54 depending upon the size, thickness and diameter of the seat rest 20 of the chair 14.

Figure 8:
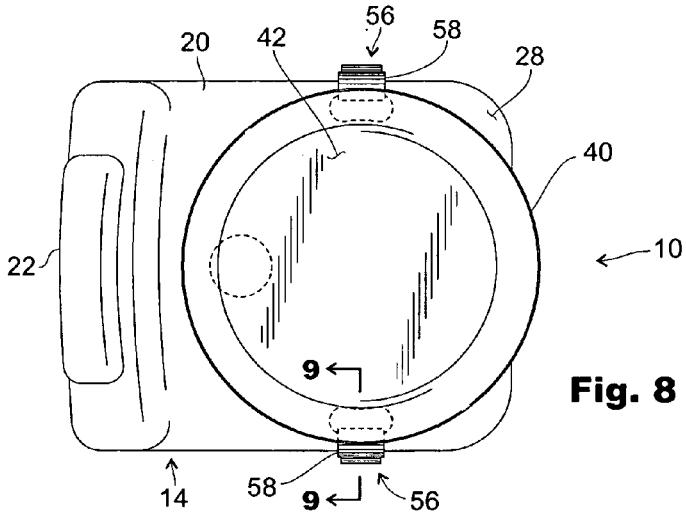
FIG. 8 is a top plan view of the eccentrically rotatable swivel seat device of the present invention illustrating an alternative attachment structure in the form of retaining members for attaching the swivel seat device to the seat rest of the chair.
Figure 9:
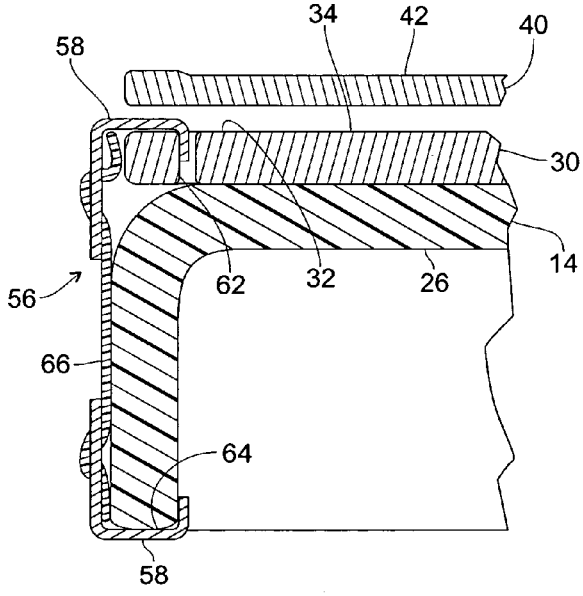
FIG. 9 is a sectioned elevational view of the eccentrically rotatable swivel seat device of the present invention taken along lines 9—9 illustrating the specific connection of the retaining member to the seat rest of the chair and the lower supporting member for attaching the swivel seat device to the chair.
Figure 10:
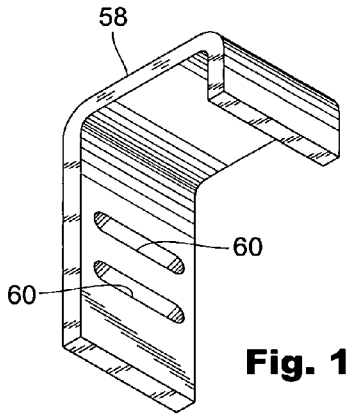
FIG. 10 is a perspective view of the eccentrically rotatable swivel seat device of the present invention illustrating one j-shaped clip of the retaining member.
Figure 11:
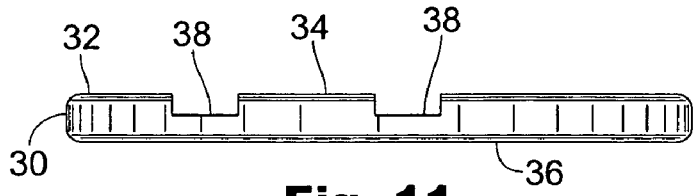
FIG. 11 is a side elevational view of the eccentrically rotatable swivel seat device of the present invention illustrating the channels extending on the upper surface of the lower supporting member for receiving the flexible straps that facilitate the securement of the swivel seat device to the seat rest of the chair.

Illustrated in FIGS. 8–10 is an alternative embodiment for a chair securement means and which includes at least one pair of retaining members 56 with the retaining members 56 disposed 180 degrees from each other for securing the lower supporting member 30 to the seat rest 20 of the chair 14. Specifically, each retaining member 56 includes a pair of j-shaped hooks or clips 58 and each j-shaped hook 58 includes a pair of longitudinal grooves 60 formed on the body portion of the respective j-shaped hook 58. One j-shaped hook 58 is attached to an annular recess 62 formed on the interior surface 34 of the lower supporting member 30 adjacent the periphery 32, and the second j-shaped hook 58 attaches and hooks about the lower edge 64 of the seat rest 20 of the chair 14. An interconnect member 66 is used to adjoin the j-shaped hooks 58 to each other. Each interconnect member 66 can be a flexible and sturdy piece a plastic or cloth having ends that are capable of removable insertion into the grooves 60 of the j-shaped hooks 58. The length of interconnect member 66 that is insertable through the grooves 60 of the j-shaped hooks 58 is adjustable to accommodate seat rests of varying depths.

Figure 14:
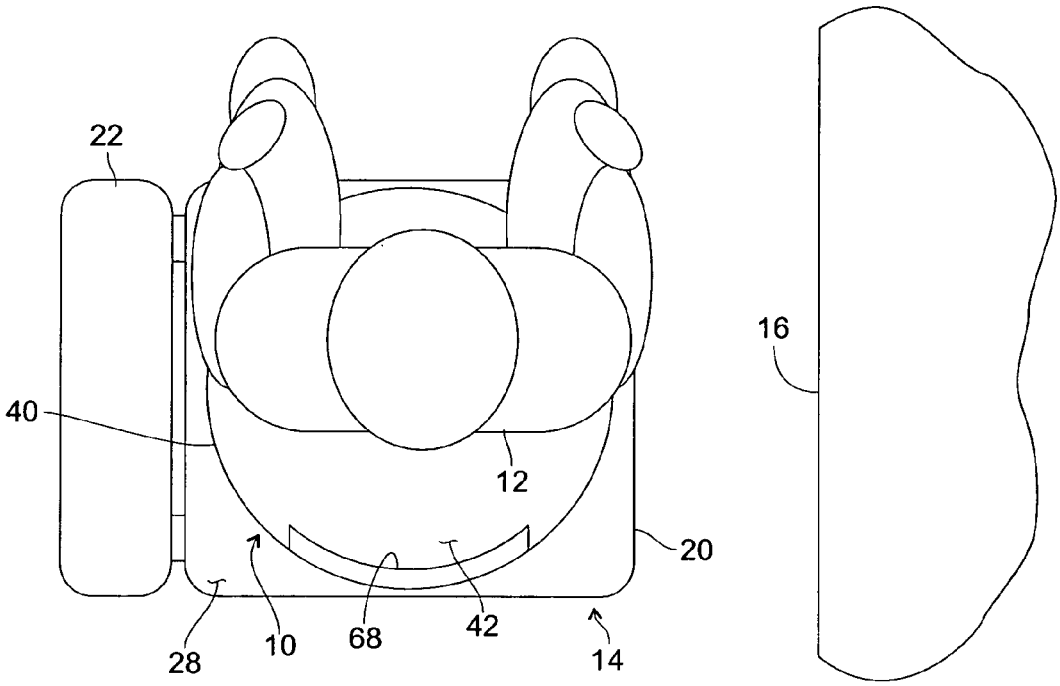
FIG. 14 is a top plan view of the alternative embodiment for the eccentrically rotatable swivel seat device first shown in FIG. 13 illustrating the individual seated on the device that is in the non-rotated disposition.
Figure 15:
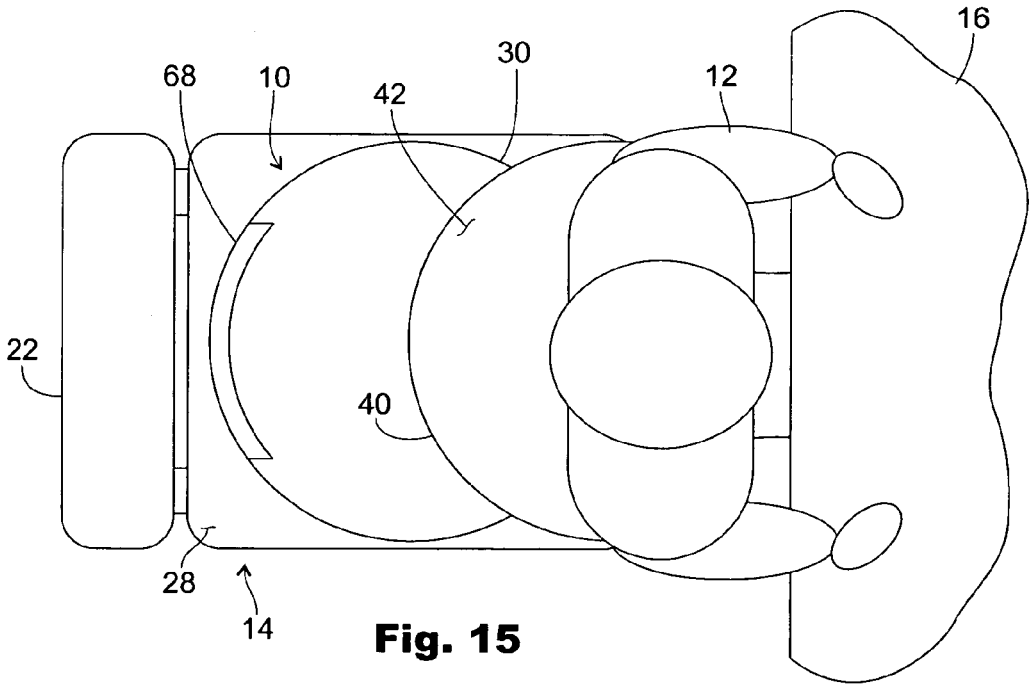
FIG. 15 is a top plan view of the alternative embodiment for the eccentrically rotatable swivel seat device first shown in FIG. 13 illustrating the individual seated on the device with the upper supporting member in the rotated disposition thereby seating the individual closer to the table.

Illustrated in FIGS. 14 and 15 is a modification for the upper supporting member 40 that includes a semi-circular backrest 68 mounted along a portion of the periphery of the upper supporting member 40. The semi-circular backrest 68 rotates concomitant with the upper supporting member 40 and allows the swivel seat device 10 to be used as a portable seat, especially for use in conjunction with a bar stool or chair that doesn't have a backrest.

Figure 6:
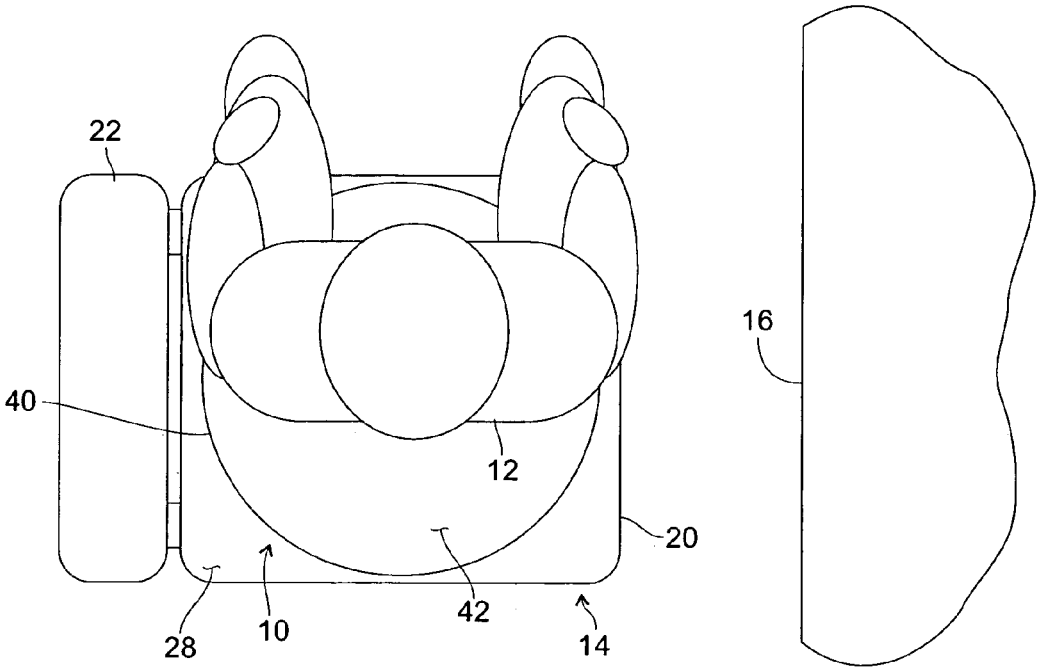
FIG. 6 is a top plan view of the eccentrically rotatable swivel seat device of the present invention illustrating the individual seated on the upper supporting member and on the chair that is near the table with the device in the non-rotated disposition.
Figure 7:
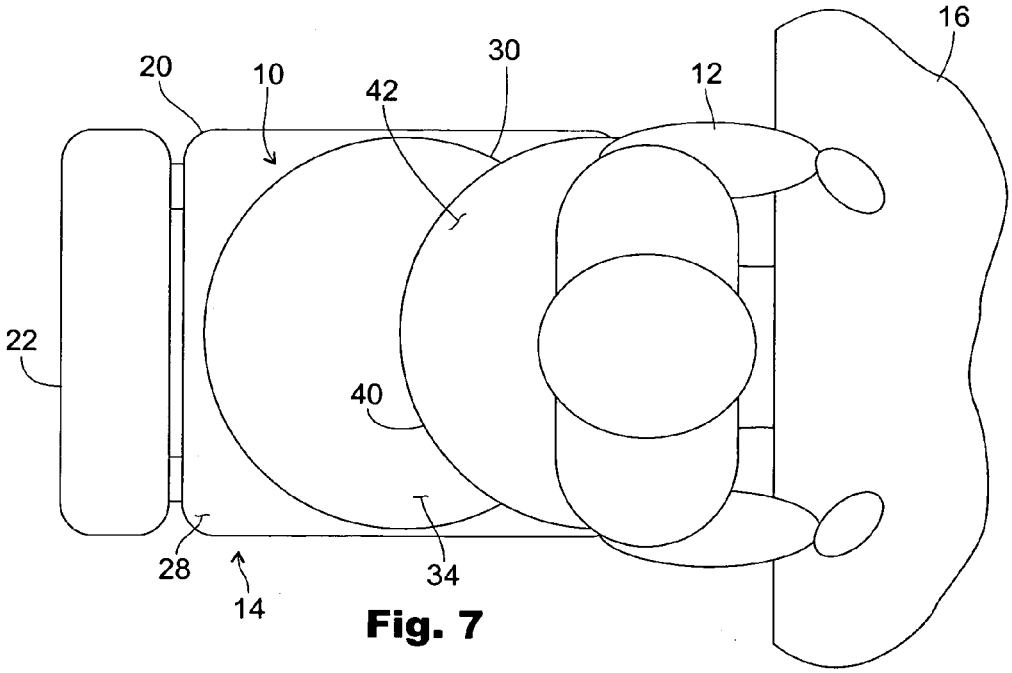
FIG. 7 is a top plan view of the eccentrically rotatable swivel seat device of the present invention illustrating the rotation of the upper supporting member for bringing the individual closer to the table without lifting or moving the chair.

Illustrated in FIGS. 6 and 14 is the position of the upper supporting member 40 when the individual 12 is initially placed thereon and the chair 14 has already been moved away from the table 16 the appropriate distance to allow for the full swiveling or rotational motion of the upper supporting member 40. FIGS. 7 and 15 illustrate the swiveling or rotational motion of the upper supporting member 40 for seating the individual 12 adjacent and forward to the table 16.

Figure 12:
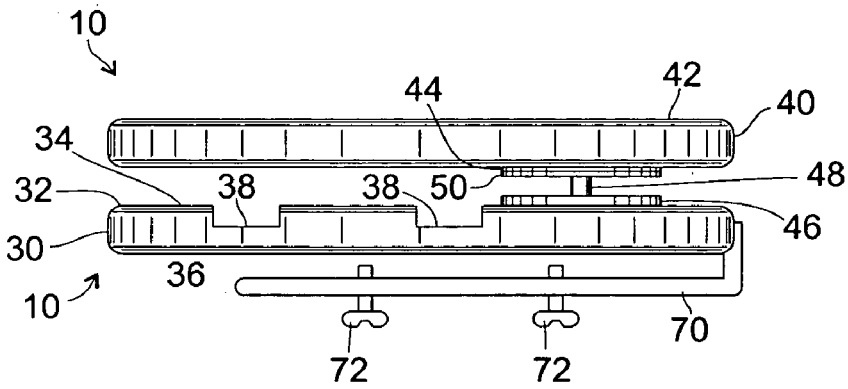
FIG. 12 is a side elevational view of the eccentrically rotatable swivel seat device of the present invention illustrating an alternative method of attaching the swivel seat device to the seat rest of the chair.
Figure 13:
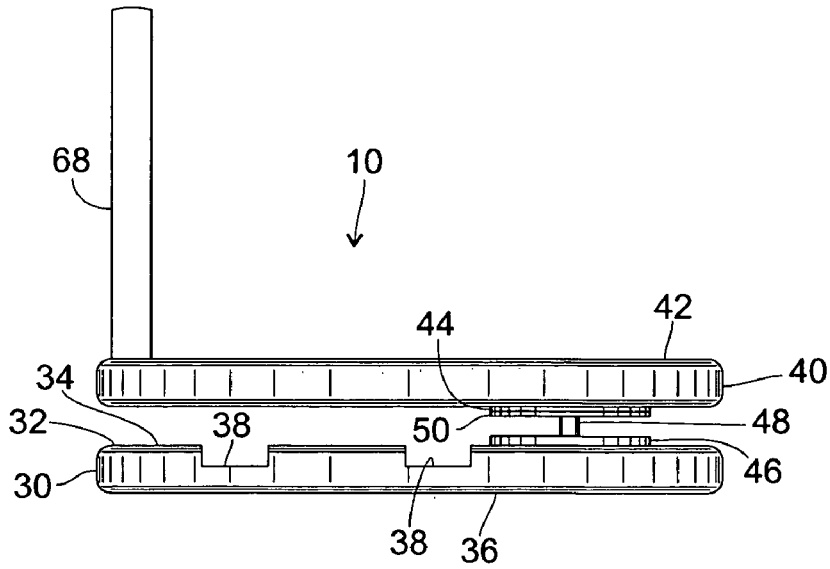
FIG. 13 is a side elevational view of an alternative embodiment for the eccentrically rotatable swivel seat device showing a backrest extending upwardly from the periphery of the upper supporting member.

Illustrated in FIG. 12 is an alternative embodiment for mounting the lower supporting member 30 to the chair 14. This embodiment includes an L-shaped attachment member 70 that connects to (either integrally or as a separate element) the lower supporting member 30. The L-shaped attachment member 70 extends transversely across a substantial portion of the diameter of the lower supporting member 30. The attachment member 30 is spaced from the seat engaging surface 36 and thus a gap is formed that allows the attachment member 70 to be slipped or slid underneath the seat rest of a chair. A pair of fasteners 72, such as thumb screws, that extending upwardly through the body of the attachment member 70, would be hand tightened for securing the lower supporting member 30 to the chair.

While this invention has been described in conjunction with several preferred embodiments, it will be obvious to those skilled in the art that numerous modifications, alterations, and variations are practicable and possible while still remaining within the spirit of the invention and the scope of the appended claims.

What is claimed is:

1. A swivel seat device, comprising:

a non-rotatable, circular-shaped lower supporting member having a periphery and at least two transverse channels extending across the diameter of the lower supporting member;

a circular-shaped upper supporting member having a seating surface and an opposite interior surface, the upper supporting member mounted eccentric to the lower supporting member for selective eccentric rotatable motion relative to the lower supporting member so that a portion of the upper supporting member is pendent and eccentric to the lower supporting member when the upper supporting member is disposed to a fully rotated position;

swiveling means interconnecting the upper supporting member to the lower supporting member for allowing the selective eccentric rotation of the upper supporting member relative to the lower supporting member; and a pair of flexible straps that are partially received within the channels of the lower supporting member and which wrap around the lower supporting member and a seat rest of a chair upon which the lower supporting member is superposed for scouring the swivel seat device to the chair.

2. The swivel seat device of claim 1 further comprising a plurality of retaining members that hook on to the lower supporting member and the seat rest of the chair for securing the lower supporting member to the chair.

3. The swivel seat device of claim 2 wherein each retaining member includes a pair of j-shaped hooks and an interconnection member for adjoining the j-shaped hooks.

4. The swivel seat device of claim 3 further comprising a semi-circular backrest mounted to the periphery of the upper supporting member and extending upwardly therefrom.

5. The swivel seat device of claim 4 further comprising an L-shaped attachment member connected to the lower supporting member and extending transversely and inwardly thereto across a substantial portion of the diameter of the lower supporting member and defining a gap therebetween so that the L-shaped attachment member can be slipped on to the seat rest of the chair.

6. The swivel seat device of claim 5 further comprising a pair of fasteners that are insertable through the L-shaped attachment member for engaging the seat rest of the chair to secure the lower supporting member to the chair.

7. A swivel seat device for securement to the seat rest of a chair, comprising:

a non-rotatable circular-shaped lower supporting member having a periphery and at least two transverse channels extending across the diameter of the lower supporting member, the lower supporting member superposed on the seat rest or the chair for removable securement thereto;

a circular-shaped upper supporting member having a seating surface and an opposite interior surface, the upper supporting member mounted eccentrically on the lower supporting member for selective eccentric rotatable motion relative to the lower supporting member so that a portion of the upper supporting member is disposed pendent and eccentric to the lower supporting member and overhangs the seat rest of the chair when the upper supporting member is moved to a fully rotated position;

swiveling means interconnecting the upper supporting member to the lower supporting member for allowing the selective eccentric rotation of the upper supporting member relative to the lower supporting member;

a pair of flexible straps that are received within the channels of the lower supporting member and which wrap around the lower supporting member and the seat rest of the chair upon which the lower supporting member is superposed for securing the lower supporting member to the chair; and a semi-circular backrest mounted to the periphery of the upper supporting member and extending upwardly therefrom.

8. The swivel seat device of claim 7 further comprising a plurality of retaining members capable of hooking on to the lower supporting member and the seat rest of the chair for securing the lower supporting member to the chair.

9. The swivel seat device of claim 8 wherein each retaining member includes a pair of j-shaped hooks with one j-shaped hook attachable to the seat rest of the chair and the other j-shaped hook attachable to the lower supporting member.

10. The swivel seat device of claim 9 wherein each retaining member includes an interconnection member for joining the j-shaped hooks to each other.

11. The swivel seat device of claim 10 further comprising an L-shaped attachment member connected to the lower supporting member and extending transversely and inwardly thereto along a substantial portion of the diameter of the lower supporting member and defining a gap therebetween so that the L-shaped attachment member can be slipped on to the seat rest for securing the lower supporting member to the chair.

12. The swivel seat device of claim 11 further comprising a pair of fasteners that are insertable through the L-shaped attachment member for engaging the seat rest and securing the lower supporting member to the chair.

13. A swivel seat device for seating an elderly, disabled or handicapped individual forward and adjacent to a table and which is securable to the seat rest of a chair, the swivel seat device, comprising:

a non-rotatable circular-shaped lower supporting member having a periphery and at least two transverse channels extending across the diameter of the lower supporting member for attaching the lower supporting member to the seat rest, the lower supporting member superposed on the seat rest of the chair for removable securement thereto;

a circular-shaped upper supporting member having a seat surface upon which the individual sits and an opposite interior surface, the upper supporting member eccentrically mounted to the lower supporting member for selective eccentric swiveling motion relative to the stationary lower supporting member whereupon a portion of the upper supporting member is disposed pendent and eccentric to the lower supporting member and overhangs the chair when the upper supporting member is moved to the fully rotated position for bringing the individual adjacent to the table;

swiveling means for interconnecting the upper supporting member to the lower supporting member thereby providing for the selective eccentric rotation of the upper supporting member relative to the lower supporting member; and an L-shaped attachment member connected to the lower supporting member and extending transversely and inwardly thereto along a substantial portion of the diameter of the lower supporting member and defining gap therebetween so that the L-shaped attachment member can be slipped on the seat rest for securing the lower supporting member to the chair.

14. The swivel seat device of claim 13 further comprising a pair of flexible straps that are receivable within the channels of the lower supporting member and which encompass the lower supporting member and the seat rest of the chair for securing the lower supporting member to the chair.

15. The swivel seat device of claim 14 further comprising a semi-circular backrest extending upwardly from the periphery of the upper supporting member.

16. The swivel seat device of claim 15 further comprising a plurality of retaining members capable of hooking on to the lower supporting member and the seat rest of the chair for securing the lower supporting member to the chair.

17. The swivel seat device of claim 16 wherein each retaining member includes a pair of j-shaped hooks with one j-shaped hook attachable to the seat rest of the chair and the other j-shaped book attachable to the lower supporting member.

18. The swivel seat device of claim 17 wherein each retaining member includes an interconnection member for joining the j-shaped hooks to each other.

* * * * *